US006253776B1

(12) United States Patent
Lin

(10) Patent No.: US 6,253,776 B1
(45) Date of Patent: Jul. 3, 2001

(54) CRUTCH

(75) Inventor: Fang-Sheng Lin, Yung Kan (TW)

(73) Assignee: Forever Young Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/599,207

(22) Filed: Jun. 22, 2000

(51) Int. Cl.[7] ..... A61H 3/02
(52) U.S. Cl. ..... 135/69; 135/68; 135/75
(58) Field of Search ..... 135/68, 69, 71, 135/72, 73, 75, 76, 77

(56) References Cited

U.S. PATENT DOCUMENTS 815,368 * 3/1906 Morse ..... 135/68
1,870,921 * 8/1932 Murka ..... 135/69
2,366,406 * 1/1945 Invidiato ..... 135/69
2,856,943 * 10/1958 Sparlin ..... 135/68
4,865,065 * 9/1989 Chen ..... 135/69
5,402,811 * 4/1995 Weng ..... 135/69 X
5,605,170 * 2/1997 Wenf ..... 135/72 X

* cited by examiner

*Primary Examiner*—Robert Canfield
(74) *Attorney, Agent, or Firm*—Alan D. Kamrath; Rider, Bennett, Egan & Arundel, LLP

(57) ABSTRACT

A crutch has a pad, two bow rods connected to the pad downward, a handpiece connected to the bow rods transversely, a bolt and a butterfly nut fastening the handpiece and the bow rods together, a spring having two ends inserted through the bow rods, a sleeve having a through hole receiving lower portions of the bow rods, a pipe receiving the lower portions of the bow rods, the pipe having a taper end and a plurality of through apertures, and a tip cushion receiving the taper end of the pipe.

2 Claims, 5 Drawing Sheets

CRUTCH

BACKGROUND OF THE INVENTION

The present invention relates to a crutch. More particularly, the present invention relates to a crutch for facilitiating a user.

Referring to FIG. 1, a conventional crutch 1' has a pad 11', two bow rods 12' connected to the pad 11' downward, a handpiece 13' connected to the bow rods 12' transversely, a pipe 14' clamped by the lower portions of two bow rods 12', an extensible rod 16' inserted beneath the pipe 14', a tip cushion 17' receiving the lower end of the extensible rod 16', and a mount 15' confining the lower ends of the pipe 14' and the bow rods 12'. A plug 142' is disposed on the upper end of the pipe 14'. Each bow rod 12' has a plurality of positioning holes 120'. A bolt 131' and a butterfly nut 132' fasten the handpiece 13' and two bow rods 12' together. The pipe 14' has a plurality of adjusting holes 140'. A protrusion 141' is disposed in the pipe 14' and inserted in one of the adjusting holes 140'. However, the conventional crutch 1' has a plurality of pins and rivets in order to assemble the crutch 1'. Thus it is very difficult to assemble the crutch 1' for the ordinary users. Furthermore, the strength of each bow rod 12' is weakened.

SUMMARY OF THE INVENTION

An object of the present invention is to provide an assembled crutch which can reinforce lower portions of two bow rods.

Another object of the present invention is to provide a crutch which can facilitate the user.

In accordance with a first preferred embodiment, a crutch comprises a pad, two bow rods connected to the pad downward, a handpiece connected to the bow rods transversely, a bolt and a butterfly nut fastening the handpiece and the bow rods together, a spring having two ends inserted through the bow rods, a sleeve having a through hole receiving lower portions of the bow rods, a pipe receiving the lower portions of the bow rods, the pipe having a taper end and a plurality of through apertures, and a tip cushion receiving the taper end of the pipe.

In accordance with a second preferred embodiment, a crutch comprises a pad, two bow rods connected to the pad downward, a handpiece connected to the bow rods transversely, a bolt and a butterfly nut fastening the handpiece and the bow rods together, two springs inserted in the bow rods respectively, a sleeve having two through holes receiving lower portions of the bow rods, a pipe receiving the lower portions of the bow rods, the pipe having a plurality of through apertures, and a tip cushion receiving the pipe. A fastener fastens two bow rods together. The fastener has an end protrusion.

DETAILED DESCRIPTION OF THE INVENTION

Figure 1:
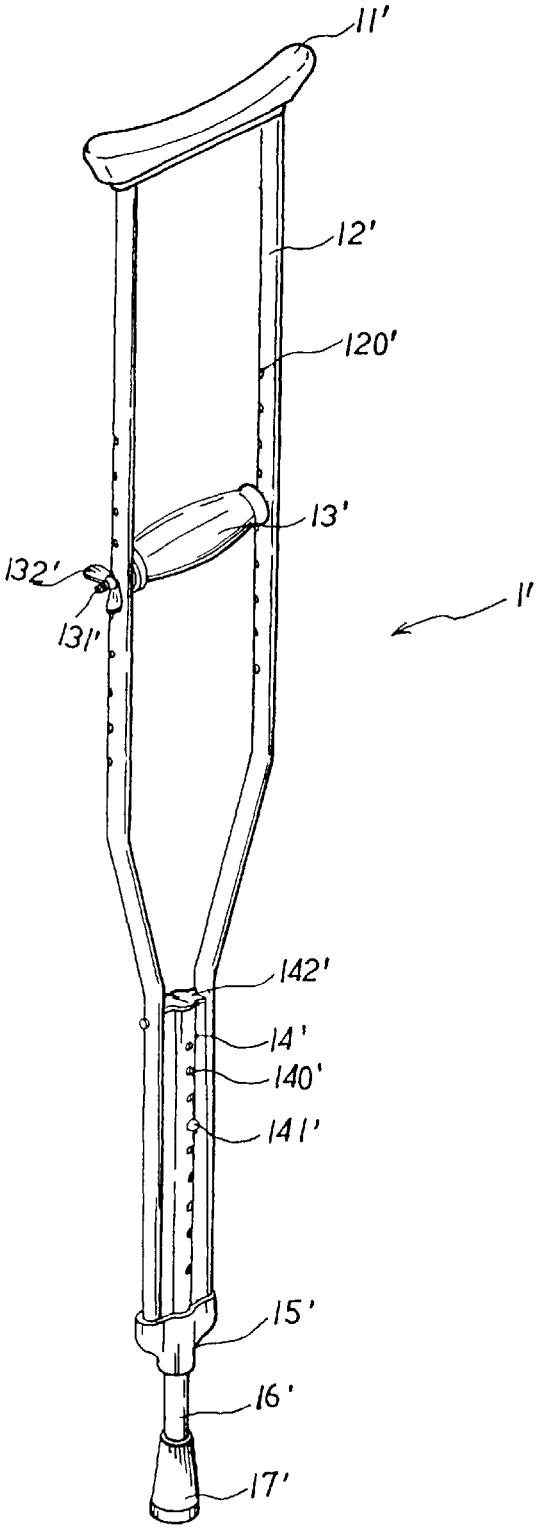
FIG. 1 PRIOR ART
FIG. 1 is a perspective assembly view of a conventional crutch of the prior art.
Figure 2:
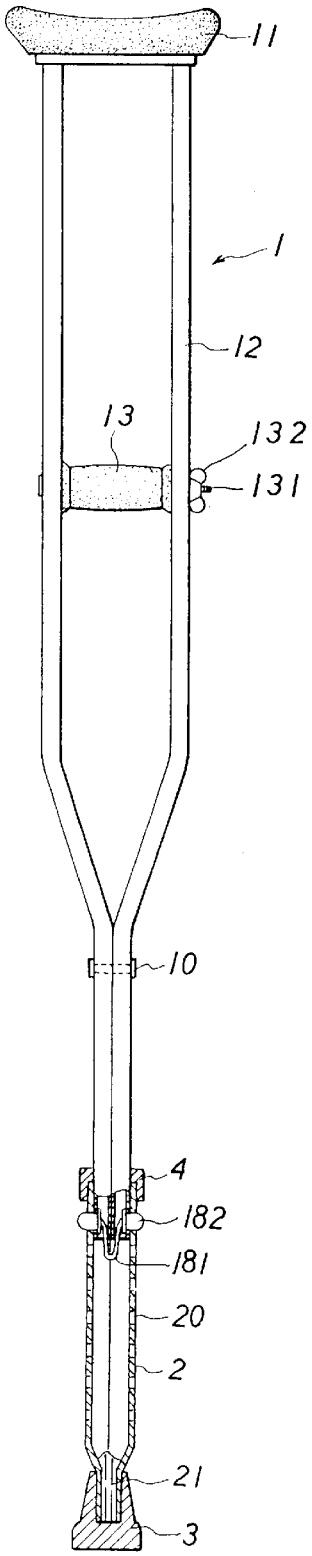
FIG. 2 is an elevational and partially sectional view of a crutch of a first preferred embodiment in accordance with the present invention.
Figure 3:
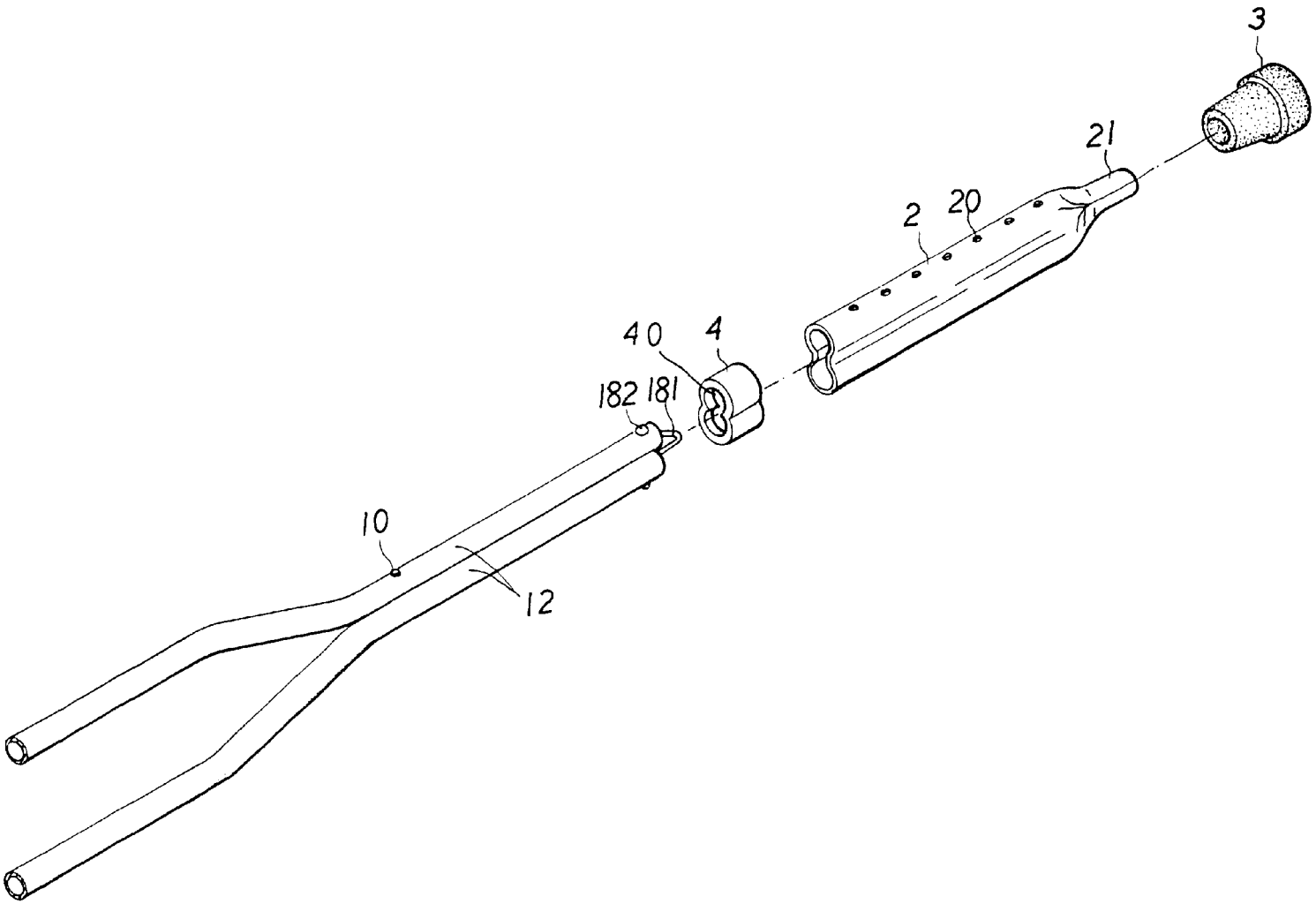
FIG. 3 is a partially perspective exploded view of a crutch of a first preferred embodiment in accordance with the present invention.

Referring to FIGS. 2 and 3, a first crutch comprises a pad 11, two bow rods 12 connected to the pad 11 downward, a handpiece 13 connected to the bow rods 12 transversely, a bolt 131 and a butterfly nut 132 fastening the handpiece 13 and the bow rods 12 together, a spring 181 having two ends 182 inserted through the bow rods 12, a sleeve 4 having a through hole 40 receiving lower portions of the bow rods 12, a pipe 2 receiving the lower portions of the bow rods 12, the pipe 2 having a taper end 21 and a plurality of through apertures 20, and a tip cushion 3 receiving the taper end 21 of the pipe 2.

A fastener 10 fastens two bow rods 12 together. Each end 182 of the spring 181 is inserted in one of the through apertures 20 of the pipe 2. When the ends 182 of the spring 181 are pressed inward, the length of the bow rods 12 will be adjusted.

Figure 4:
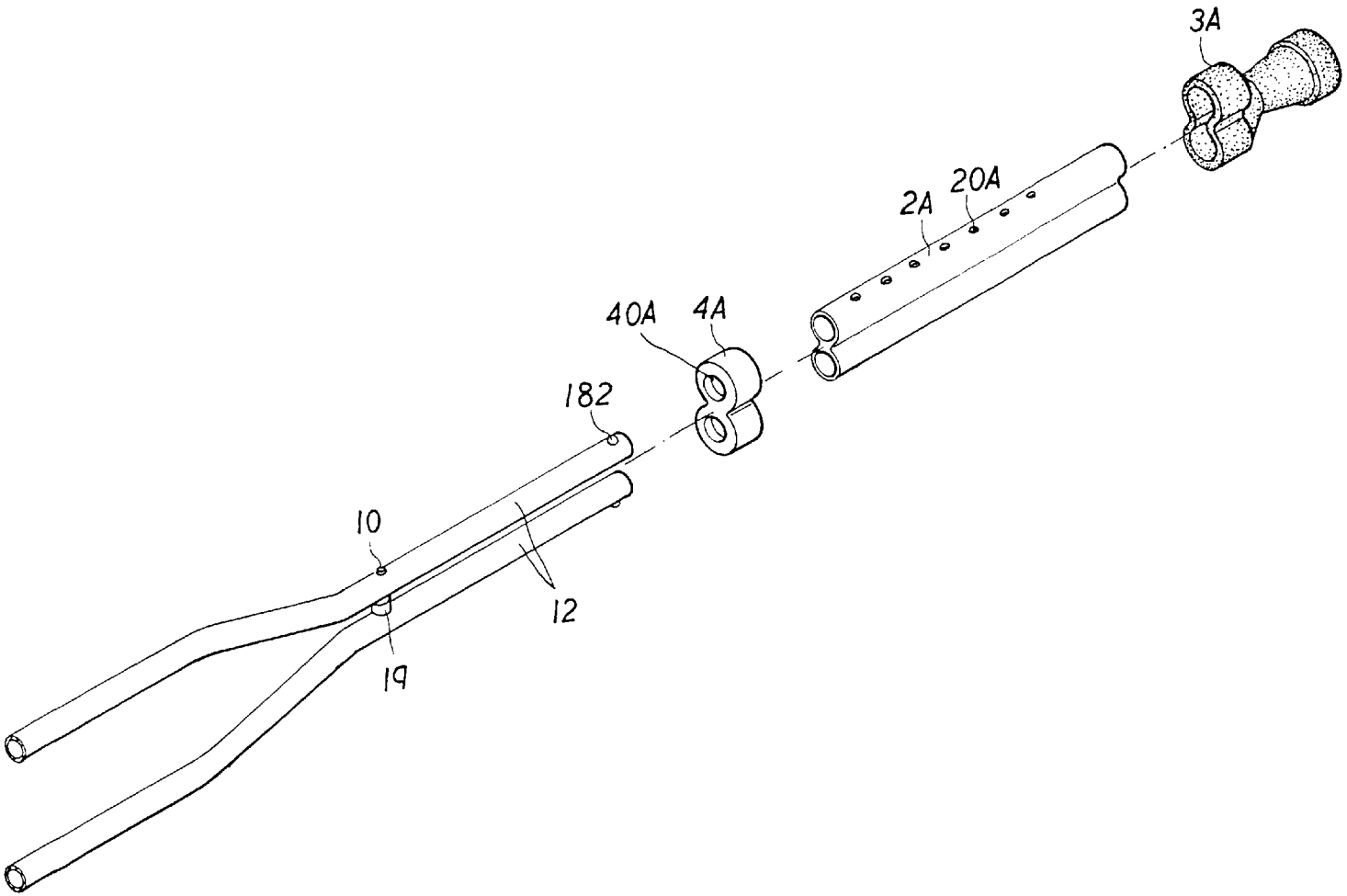
FIG. 4 is a partially perspective exploded view of a crutch of a second preferred embodiment in accordance with the present invention.

Referring to FIG. 4, a second crutch comprises a pad, two bow rods 12 connected to the pad downward, a handpiece connected to the bow rods 12 transversely, a bolt and a butterfly nut fastening the handpiece and the bow rods 12 together, two springs 182 inserted in the bow rods 12 respectively, a sleeve 4*a* having two through holes 40*a* receiving lower portions of the bow rods 12, a pipe 2*a* receiving the lower portions of the bow rods 12, the pipe 2*a* having a plurality of through apertures 20*a*, and a tip cushion 3*a* receiving the pipe 2*a*.

A fastener 19 fastens two bow rods 12 together. The fastener 19 has an end protrusion 10.

Figure 5:
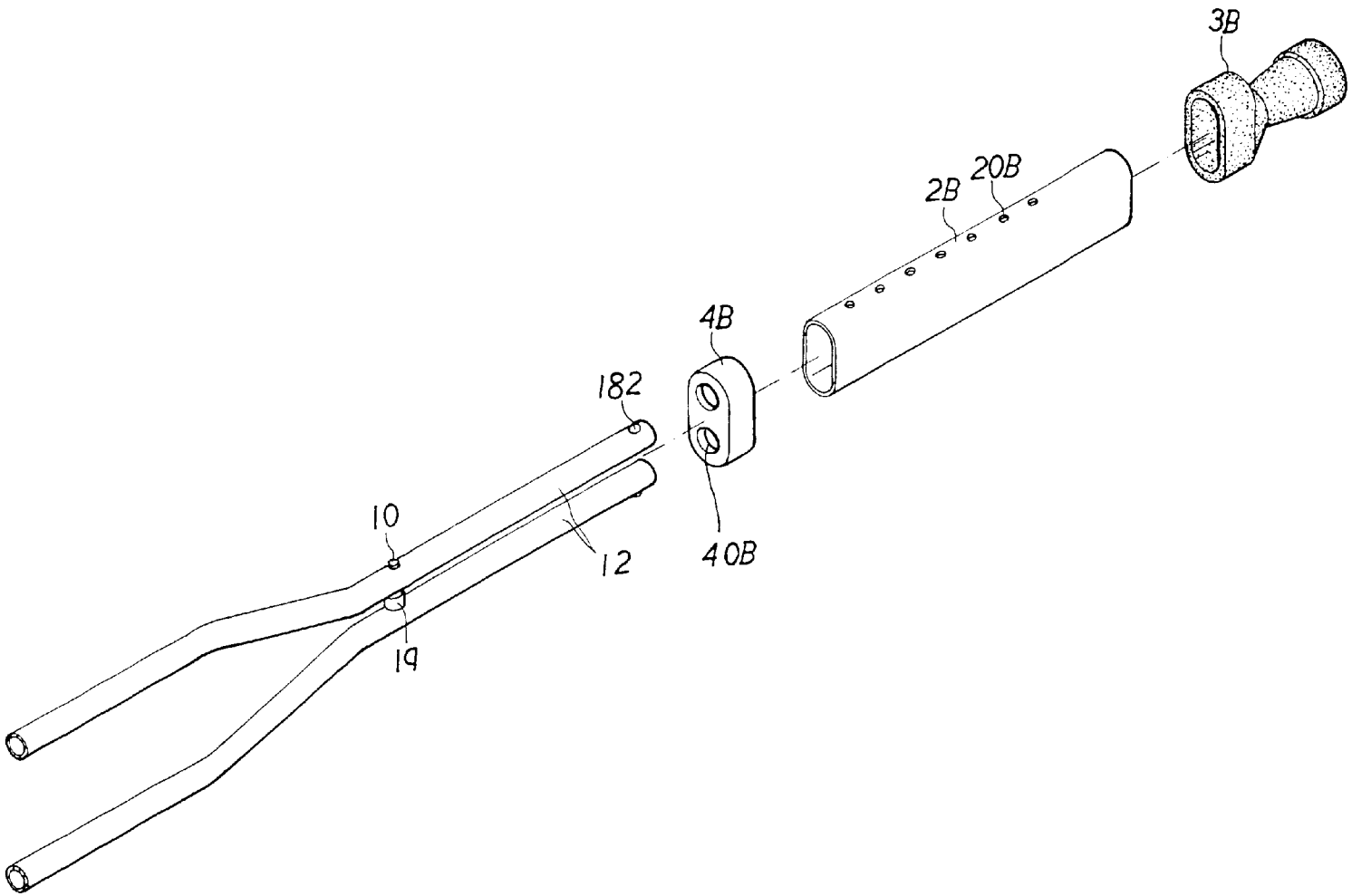
FIG. 5 is a partially perspective exploded view of a crutch of a first preferred embodiment in accordance with the present invention.

Referring to FIG. 5, a third crutch comprises a pad; two bow rods 12 connected to the pad downward, a handpiece connected to the bow rods 12 transversely, a bolt and a butterfly nut fastening the handpiece and the bow rods 12 together, two springs 182 inserted in the bow rods 12 respectively, a sleeve 4*b* having two through holes 40*b* receiving lower portions of the bow rods 12, a pipe 2*b* receiving the lower portions of the bow rods 12, the pipe 2*b* having a plurality of through apertures 20*b*, and a tip cushion 3*b* receiving the pipe 2*b*.

A fastener 19 fastens two bow rods 12 together. The fastener 19 has an end protrusion 10.

The invention is not limited to the above embodiment but various modification thereof may be made. Further, various changes in form and detail may be made without departing from the scope of the invention.

I claim:

1. A crutch comprises:

a pad and two bow rods connected to the pad downward, a handpiece connected to the bow rods transversely, a bolt and a butterfly nut fastening the handpiece and the bow rods together, a spring having two ends inserted through the bow rods, a sleeve having a through hole receiving lower portions of the bow rods, a pipe receiving the lower portions of the bow rods, the pipe having a taper end and a plurality of through apertures, and a tip cushion receiving the taper end of the pipe.

2. The crutch as claimed in claim 1, wherein the sleeve has an additional through hole.

* * * * *